US006717283B2

(12) United States Patent
Skinner et al.

(10) Patent No.: US 6,717,283 B2
(45) Date of Patent: Apr. 6, 2004

(54) ANNULUS PRESSURE OPERATED ELECTRIC POWER GENERATOR

(75) Inventors: Neal G. Skinner, Lewisville, TX (US); Michael L. Fripp, Carrollon, TX (US); Roger L. Schultz, Aubrey, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/026,175

(22) Filed: Dec. 20, 2001

(65) Prior Publication Data

US 2003/0116969 A1 Jun. 26, 2003

(51) Int. Cl.[7] ..... F03D 9/00
(52) U.S. Cl. ..... 290/43; 290/54; 310/15
(58) Field of Search ..... 290/44, 43, 54; 310/15

(56) References Cited

U.S. PATENT DOCUMENTS

| | | | | | |
|---|---|---|---|---|---|
| 3,610,216 | A | * | 10/1971 | Braun | 123/46 R |
| 3,743,013 | A | * | 7/1973 | Harbonn | 166/368 |
| 3,970,877 | A | * | 7/1976 | Russell et al. | 310/339 |
| 4,422,506 | A | | 12/1983 | Beck | |
| 4,429,748 | A | | 2/1984 | Beck | |
| 4,444,267 | A | | 4/1984 | Beck | |
| 4,444,268 | A | | 4/1984 | Barrington | |
| 4,491,738 | A | * | 1/1985 | Kamp | 290/43 |
| 4,515,219 | A | | 5/1985 | Beck | |
| 4,515,225 | A | * | 5/1985 | Dailey | 175/40 |
| 4,532,614 | A | * | 7/1985 | Peppers | 367/81 |
| 4,537,258 | A | | 8/1985 | Beck | |
| 4,633,952 | A | | 1/1987 | Ringgenberg | |
| 4,667,743 | A | | 5/1987 | Ringgenberg et al. | |
| 4,711,305 | A | | 12/1987 | Ringgenberg | |
| 4,736,798 | A | | 4/1988 | Zunkel | |
| 5,101,907 | A | * | 4/1992 | Schultz et al. | 166/386 |
| 5,149,984 | A | * | 9/1992 | Schultz et al. | 290/54 |
| 5,362,987 | A | * | 11/1994 | Cassaday et al. | 290/54 |
| 5,839,508 | A | * | 11/1998 | Tubel et al. | 166/65.1 |
| 5,965,964 | A | * | 10/1999 | Skinner et al. | 310/15 |
| 6,502,393 | B1 | * | 1/2003 | Stephenson et al. | 60/414 |

FOREIGN PATENT DOCUMENTS

| | | | | |
|---|---|---|---|---|
| EP | 500343 A1 | * | 8/1992 | E21B/23/04 |

* cited by examiner

*Primary Examiner*—Joseph Waks
(74) *Attorney, Agent, or Firm*—Marlin R. Smith

(57) ABSTRACT

Electric power is generated downhole by changes in annulus pressure. In a described embodiment, a system for generating electric power includes a piston, an accumulator, a reservoir of hydraulic fluid, a turbine, and a generator. A change in annulus pressure causes displacement of the piston due to a pressure differential between the annulus and the accumulator. Piston displacement causes the hydraulic fluid to flow through the turbine, thereby driving the generator to generate electricity.

50 Claims, 8 Drawing Sheets

ANNULUS PRESSURE OPERATED ELECTRIC POWER GENERATOR

BACKGROUND

The present invention relates generally to equipment utilized in conjunction with a subterranean well and, in an embodiment described herein, more particularly provides an annulus pressure operated electric power generator.

Only a few practical options presently exist for long term provision of electricity to power consuming electric circuits downhole. Batteries and an electric umbilical line extending from the surface to the downhole electric circuit are the most widely implemented of these options. Each of these suffers from some limitations.

An electric umbilical line is exposed to damage during installation and is relatively expensive to install. Batteries which can withstand downhole temperatures are relatively expensive but, unfortunately, are short-lived. Thus, batteries must be replaced periodically.

This periodic replacement requires the downhole assembly to be pulled, or requires the spent batteries to be retrieved separately from the downhole assembly and then replaced with fresh batteries. The former procedure is time-consuming and expensive, and the latter procedure requires an intervention into the well with wireline or slickline equipment.

Thus, it may be seen that it would be very desirable to provide a method of generating electric power downhole to power downhole electric circuits. The electric power generating system would preferably operate using annulus pressure, which is easily controllable from the surface.

SUMMARY

In carrying out the principles of the present invention, in accordance with an embodiment thereof, an annulus pressure operated electric power generator is provided. An electric generating system uses increases and decreases in annulus pressure to generate electric power. Methods of generating electric power downhole are also provided.

In one aspect of the invention, an electric power generating system is provided in which fluid flow into and out of an accumulator in response to pressure increase and pressure decrease, respectively, in an annulus is used to drive a generator. For example, the generator may generate direct current having one polarity when fluid flows into the accumulator, and the generator may generate direct current having an opposite polarity when fluid flows out of the accumulator. The generator may be driven by a turbine, by a mechanical linkage, or by other means. Alternatively, the generator may include separate portions, such as a coil and magnets, which are displaced relative to one another to generate electricity.

In another aspect of the invention, an electric power generating system is provided in which pressure increases and decreases in an annulus displace a piston. Displacement of the piston forces fluid to circulate through a hydraulic circuit. A turbine is interconnected in the hydraulic circuit so that, when fluid flows through the circuit, the turbine rotates. Turbine rotation drives a generator, which produces electricity.

In yet another aspect of the invention, a method is provided in which electric power is generated when annulus pressure is increased, and electric power is generated when annulus pressure is decreased. The electric power may be generated in direct current form, and the polarity (i.e., direction of current flow) may be opposite between annulus pressure increases and annulus pressure decreases. In that case, a full wave rectifier may be used to produce a consistent current flow direction for a downhole electric circuit. The electric power may alternatively be generated in alternating current form, whether annulus pressure is increased or decreased.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
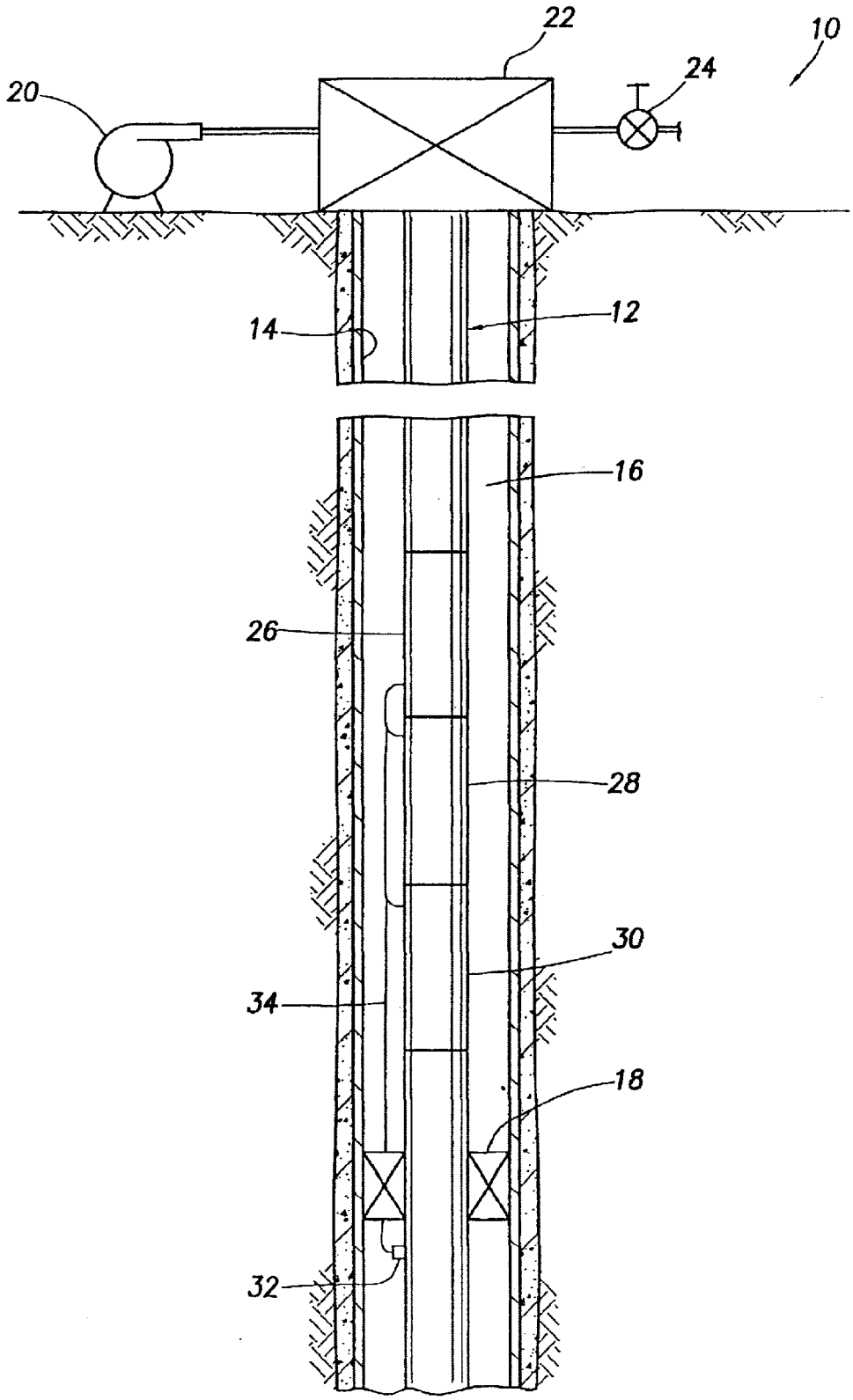
FIG. 1 is a cross-sectional view of a method of generating electric power downhole, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, a tubular string 12 is positioned in a wellbore 14, thereby defining an annulus 16 between the tubular string and the wellbore. The tubular string 12 may be a production tubing string through which fluid from a zone intersected by the wellbore 14 is produced to the surface. A packer 18 isolates the annulus 16 from the producing zone and, thus, from the interior of the tubing string 12. However, it is to be clearly understood that other types of tubular strings (for example, injection strings, drill strings, etc.) may be used, and other means of isolating the annulus 16 may be used, without departing from the principles of the invention.

A pump 20 positioned at a remote location, such as the surface, is used to apply pressure to the annulus 16. For example, the pump 20 may be in communication with the annulus 16 via a wellhead 22 at the surface. Of course, if the well is a subsea well, the pump 20 and/or wellhead 22 may be located at the seabed. Thus, it should be appreciated that the various items of equipment used in the method 10 described herein may be otherwise located and configured, in keeping with the principles of the invention.

A valve 24 is used to release pressure from the annulus 16, for example, via the wellhead 22. As with the pump 20 and wellhead 22, the valve 24 may be positioned in any location relative to the well. Operation of the pump 20 and valve 24 may be automatic and may be computer controlled. For example, a computer system (not shown) may be connected to the pump 20 and valve 24, and may be programmed to alternately operate the pump to apply pressure to the annulus 16 and operate the valve 24 to release the pressure from the annulus.

Equipment other than the pump 20 may be used to increase pressure in the annulus 16. For example, a container of pressurized gas, such as Nitrogen, may be used to increase the pressure in the annulus 16. Furthermore, equipment other than the valve 24 may be used to decrease pressure in the annulus 16. For example, a volume of the annulus 16 may be increased to thereby decrease the pressure therein. Thus, it may be seen that the principles of the invention are not limited to the specific items of equipment illustrated in FIG. 1.

Preferably, pressure in the annulus 16 is alternately increased and decreased in the method 10. These changes in annulus pressure are used by a downhole electric power generator assembly 26 to generate electricity for use downhole. However, note that it is not necessary for annulus pressure increases to be alternated with annulus pressure decreases in keeping with the principles of the invention, since electricity could be generated using a succession of pressure increases, a succession of pressure decreases, or any other combination of pressure changes in the annulus 16.

A pressure increase in the annulus 16 used to generate electricity by the generator assembly 26 is preferably an increase above hydrostatic pressure in the annulus proximate the generator assembly. A pressure decrease used to generate electricity is preferably a decrease relative to that prior increase above hydrostatic pressure. However, it will be readily appreciated that pressure increases and decreases may be obtained in the annulus 16, whether or not they are above, below or equal to hydrostatic pressure at the generator assembly 26.

Electric power generated by the generator assembly 26 is used to operate a variety of devices in the well. For example, a communication device 28 (such as an acoustic or electromagnetic telemetry device), a flow control device 30 (such as a valve or choke) and a sensing device 32 (such as a pressure sensor, a temperature sensor, a water cut sensor, etc.) may be connected to the system 26 via lines 34. These devices 28, 30, 32 and lines 34 may be positioned anywhere in the well, such as above or below the packer 18, internal or external to the tubular string 12, interconnected in or separate from the tubular string, etc.

Due to the fact that the generator assembly 26 generates electric power from pressure changes in the annulus 16, which are readily controlled from a remote location, such as the surface, there is no need to install an electric umbilical from the surface to the power-consuming devices 28, 30, 32, and there is no need to use batteries downhole. However, for relatively short-term installations, or in other situations, it may be desirable to use electric power generated by the generator assembly 26 to charge batteries downhole. In this manner, it would not be necessary to retrieve discharged batteries to recharge them or to replace them with charged batteries.

Figure 2:
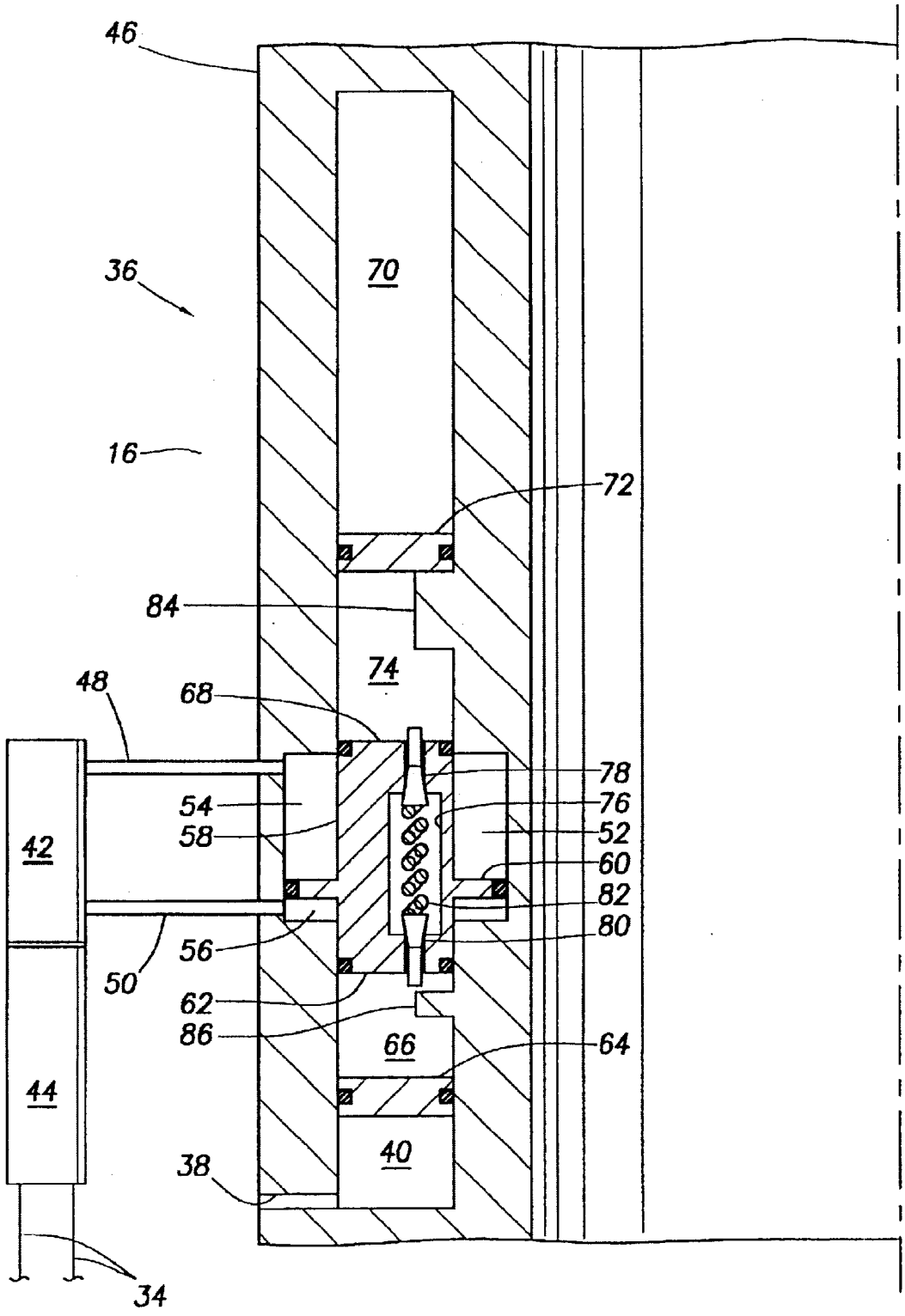
FIG. 2 is a quarter-sectional view of a first system for generating electric power downhole, the first system embodying principles of the invention and being shown in an initial configuration.

Referring additionally now to FIG. 2, a generator assembly 36 embodying principles of the present invention is representatively and schematically illustrated. The generator assembly 36 may be used for the generator assembly 26 in the method 10 described above. Of course, the generator assembly 36 may be used in other methods without departing from the principles of the invention.

When used in the method 10, the generator assembly 36 is exposed externally to pressure in the annulus 16. A port 38 admits this pressure into an annular chamber 40. As the pressure in the annulus 16 changes, preferably by alternately increasing and decreasing, the generator assembly 36 generates electricity in response to the pressure changes.

The generator assembly 36 includes a hydraulic motor 42 connected to a generator 44. The term "hydraulic motor" is used herein to generically describe any device which converts fluid flow into physical displacement. Preferably, the hydraulic motor 42 is a turbine of the type well known to those skilled in the art, but it could also be a hydraulic drill motor, a motor which produces a controlled linear displacement in response to fluid flow therethrough, or any other type of hydraulic motor.

The term "generator" is used herein to generically describe any device which converts physical displacement into electric power. Preferably, the generator 44 is a device which produces direct current electricity in response to the hydraulic motor 42 displacement, but it could also be an alternator which produces alternating current electricity, or any other type of electricity generator.

For ease of understanding the operation of the generator assembly 36, the hydraulic motor 42 and generator 44 are shown as being positioned external to a housing 46 of the assembly, with two hydraulic lines 48, 50 providing fluid communication between the hydraulic motor and a hydraulic fluid reservoir 52 in the housing. However, it should be understood that the hydraulic motor 42, generator 44 and lines 48, 50 could be otherwise positioned, such as internal to the housing 46.

To operate the hydraulic motor 42, hydraulic fluid (such as silicone or petroleum based oil, etc.) is pumped between an upper chamber 54 and a lower chamber 56 of the reservoir 52. The hydraulic fluid flows through a hydraulic circuit including the lines 48, 50 and the hydraulic motor 42 when it flows between the chambers 54, 56. When the hydraulic fluid flows through the hydraulic motor 42, the hydraulic motor produces a displacement (such as rotation of a turbine rotor) which is used by the generator 44 to produce electric power.

A piston 58 is reciprocably and sealingly received in the housing 46. As used herein, the term "piston" is used broadly to refer to any structure which displaces in response to a pressure differential thereacross. Other similar structures include bellows, baffles, membranes, etc., each of which may be used in place of the depicted piston 58.

The piston 58 includes a radially extended portion 60 which separates the upper and lower chambers 54, 56 of the reservoir 52. A lower surface area 62 of the piston 58 is exposed to pressure in the annulus 16 via a floating piston 64 which separates the chamber 40 from another chamber 66 filled with a clean fluid, such as oil.

An upper surface area 68 of the piston 58 is exposed to pressure in an accumulator 70. Preferably, the accumulator 70 contains a pressurized gas, such as Nitrogen, but it is to be clearly understood that other pressurized fluids may be used, and other types of accumulators may be used, without departing from the principles of the invention. A floating piston 72 separates the gas in the accumulator 70 from a clean fluid, such as oil, in a chamber 74 above the piston 58.

A passage 76 provides fluid communication between the chambers 74, 66 above and below the piston 58. Opposing check valves 78, 80, however, prevent flow between the chambers 66, 74 through the passage 76, except in certain circumstances which are described below. A spring 82 biases both of the check valves 78, 80 to close.

The upper check valve 78 opens when pressure in the upper chamber 74 exceeds pressure in the passage 76, or when the piston 58 has displaced upwardly sufficiently far for the check valve to contact a shoulder 84. The shoulder 84 also serves to limit downward displacement of the piston 72 and to limit upward displacement of the piston 58.

The lower check valve 80 opens when pressure in the lower chamber 66 exceeds pressure in the passage 76, or when the piston 58 has displaced downwardly sufficiently far for the check valve to contact a shoulder 86. The shoulder 86 also serves to limit downward displacement of the piston 58 and to limit upward displacement of the piston 64.

As depicted in FIG. 2, the generator assembly 36 is in a configuration in which it is initially run into a well, such as interconnected in the tubular string 12 in the method 10. The accumulator 70 has been charged with pressurized Nitrogen, forcing the piston 72 downward against the shoulder 84. Both of the check valves 78, 80 are closed, since pressure in neither of the chambers 66, 74 exceeds pressure in the passage 76.

Figure 3:
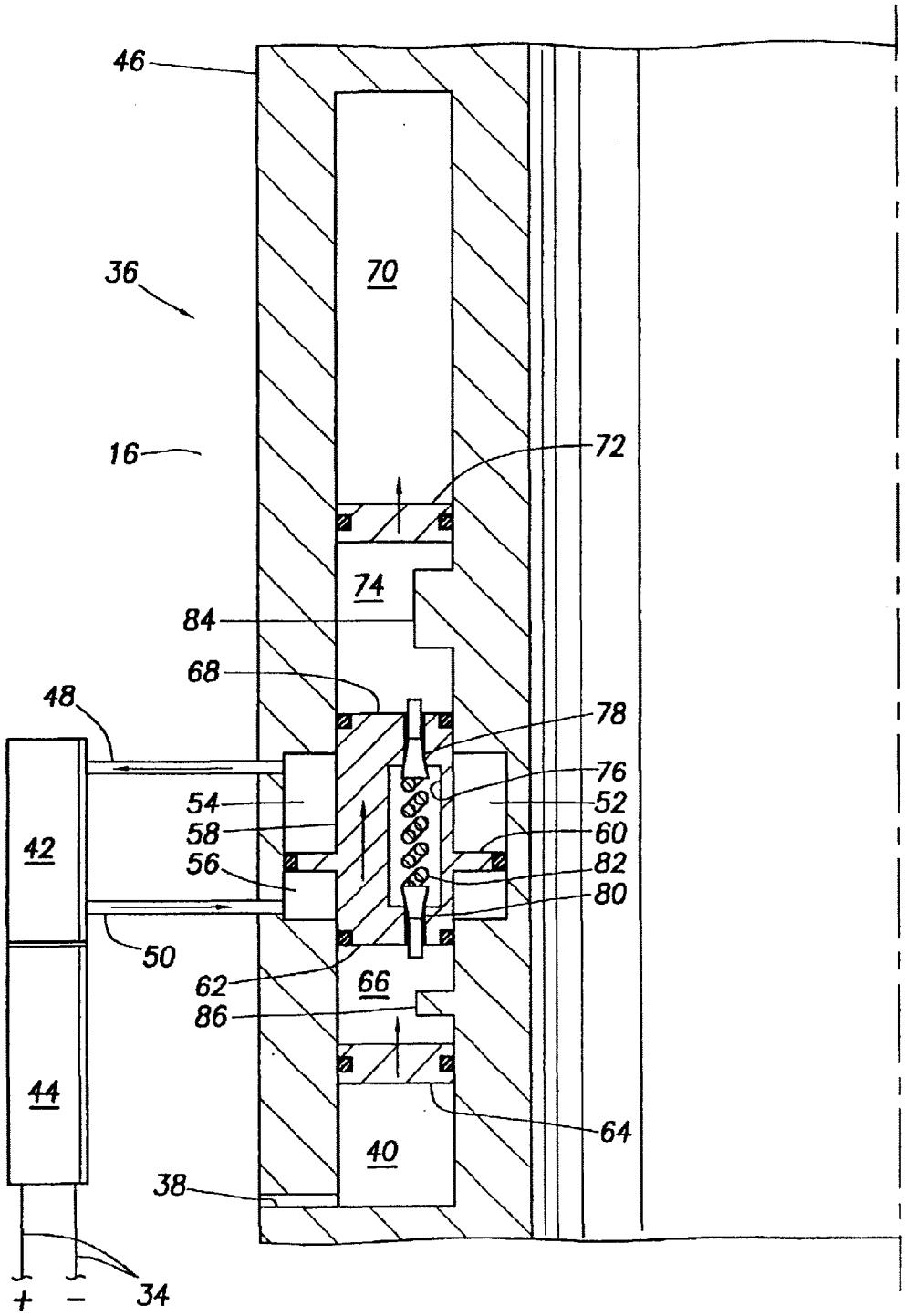
FIG. 3 is a quarter-sectional view of the first system, shown in a configuration in which annulus pressure is being increased.

Referring additionally now to FIG. 3, the generator assembly 36 is depicted as pressure in the annulus 16 is increased. The increased annulus pressure causes the piston 58 to displace upwardly, and the extended portion 60 of the piston forces hydraulic fluid to flow from the upper chamber 54 through the line 48 (in the direction indicated by the arrow superimposed on the line), through the hydraulic motor 42, through the line 50 (in the direction of the arrow superimposed on the line), and into the lower chamber 56. The hydraulic fluid flowing through the hydraulic motor 42 causes the generator 44 to generate electricity as described above.

To displace the piston 58 upward, the increased annulus pressure enters the port 38 (i.e., well fluid from the annulus 16 flows into the port) and is applied to the piston 64. The piston 64 displaces upwardly (as indicated by the arrow superimposed on the piston), thereby applying the increased pressure to the lower chamber 66. Since pressure in the lower chamber 66 applied to the lower surface area 62 of the piston 58 now exceeds pressure in the upper chamber 74 applied to the upper surface area 68 of the piston, the piston is biased upwardly.

Preferably, the accumulator 70 was initially charged so that, when pressure in the annulus 16 is increased as depicted in FIG. 3, the piston 58 will displace upwardly. This will occur if the downwardly biasing force exerted on the piston 58 by the pressure in the accumulator 70 (via the fluid in the upper chamber 74) is exceeded by the upwardly biasing force exerted on the piston by the pressure in the annulus 16 (via the fluid in the lower chamber 66). If the surface areas 62, 68 are equal, this upward displacement of the piston 58 may be ensured by initially charging the accumulator so that the increased annulus pressure will exceed the accumulator pressure downhole. This may also be accomplished by appropriately adjusting the relative sizes of the surface areas 62, 68, etc., using techniques well known to those skilled in the art.

When pressure in the annulus 16 is increased, the lower check valve 80 will open as pressure in the lower chamber 66 exceeds pressure in the passage 76. However, the upper check valve 78 will not open until the piston 58 has displaced upwardly sufficiently far for the check valve to contact the shoulder 84. When this happens, both check valves 78, 80 will be open and fluid may flow from the lower chamber 66 to the upper chamber 74 through the passage 76.

Opening of both of the check valves 78, 80 equalizes pressure across the piston 58, thereby ceasing its upward displacement. Opening of the check valves 78, 80 also permits the accumulator 70 to be charged to an increased pressure, due to fluid flowing in behind the piston 74 as it displaces upward. Upward displacement of the piston 74 decreases the gas volume in the accumulator 70, thereby increasing its pressure.

Figure 4:
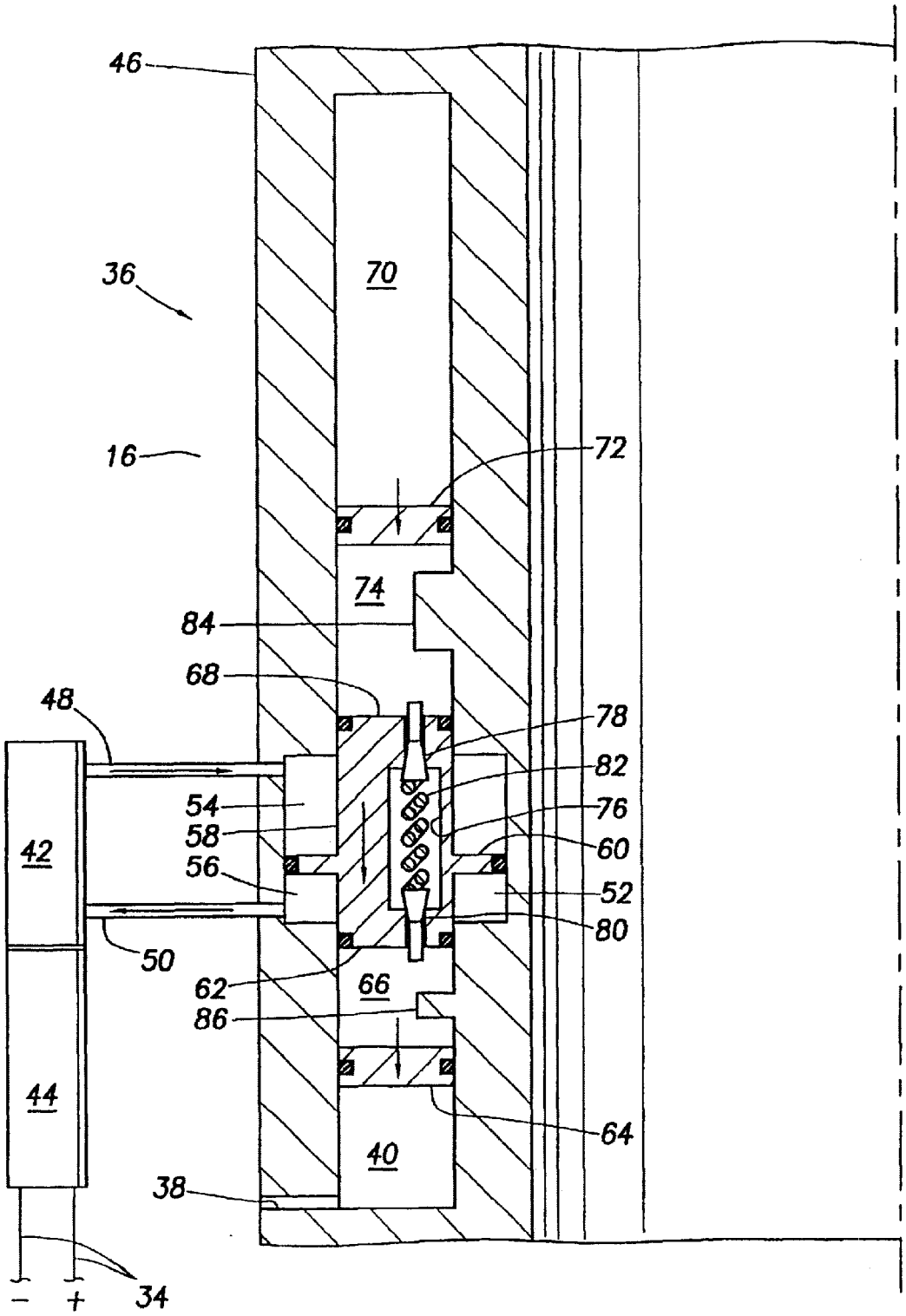
FIG. 4 is a quarter-sectional view of the first system, shown in a configuration in which annulus pressure is being decreased.

Referring additionally now to FIG. 4, the generator assembly 36 is depicted as pressure in the annulus 16 is decreased. The decreased annulus pressure causes the piston 58 to displace downwardly, and the extended portion 60 of the piston forces hydraulic fluid to flow from the lower chamber 56 through the line 50 (in the direction indicated by the arrow superimposed on the line), through the hydraulic motor 42, through the line 48 (in the direction of the arrow superimposed on the line), and into the upper chamber 54.

The hydraulic fluid flowing through the hydraulic motor 42 causes the generator 44 to generate electricity as described above. However, note that the polarity of the electrical output may be the opposite of that produced when annulus pressure is increased (as shown in FIG. 3) if the generator 44 is a direct current generator and the hydraulic motor 42 is a turbine which rotates in an opposite direction when fluid flows therethrough in an opposite direction as compared to that depicted in FIG. 3. Thus, the polarity of the electrical output of the generator 44 may reverse as pressure in the annulus 16 alternates between increasing and decreasing.

As depicted in FIG. 4, decreasing pressure in the annulus 16 is communicated to the chamber 40 via the port 38. Pressure in the accumulator 70 is greater than the decreased pressure in the annulus 16, due to the fact that the accumulator was charged to an increased pressure in the annulus as described above. Since the pressure in the accumulator 70 is greater than this decreased pressure, the pistons 58, 64 and 72 will displace downwardly (as indicated by the arrows superimposed on the pistons).

As the piston 58 displaces downwardly, the upper check valve 78 momentarily opens when pressure in the upper chamber 74 is greater then pressure in the passage 76. The lower check valve 80 remains closed as the piston 58 displaces downwardly, until the check valve contacts the shoulder 86. Contact between the check valve 80 and the shoulder 86 opens the check valve, thereby equalizing pressure across the piston 58. The piston 72 may bottom out against the shoulder 84 if the pressure in the annulus 16 is decreased below that in the accumulator 70.

It will be readily appreciated that, by alternately increasing and decreasing pressure in the annulus 16, the piston 58 may be reciprocated upwardly and downwardly, thereby producing electricity each time the annulus pressure is changed. Of course, annulus pressure could be increased an incremental amount multiple times to produce electricity each time the pressure is increased, annulus pressure could be decreased an incremental amount multiple times to produce electricity each time the pressure is decreased, or any combination of pressure increases and decreases could be used.

Figure 5:
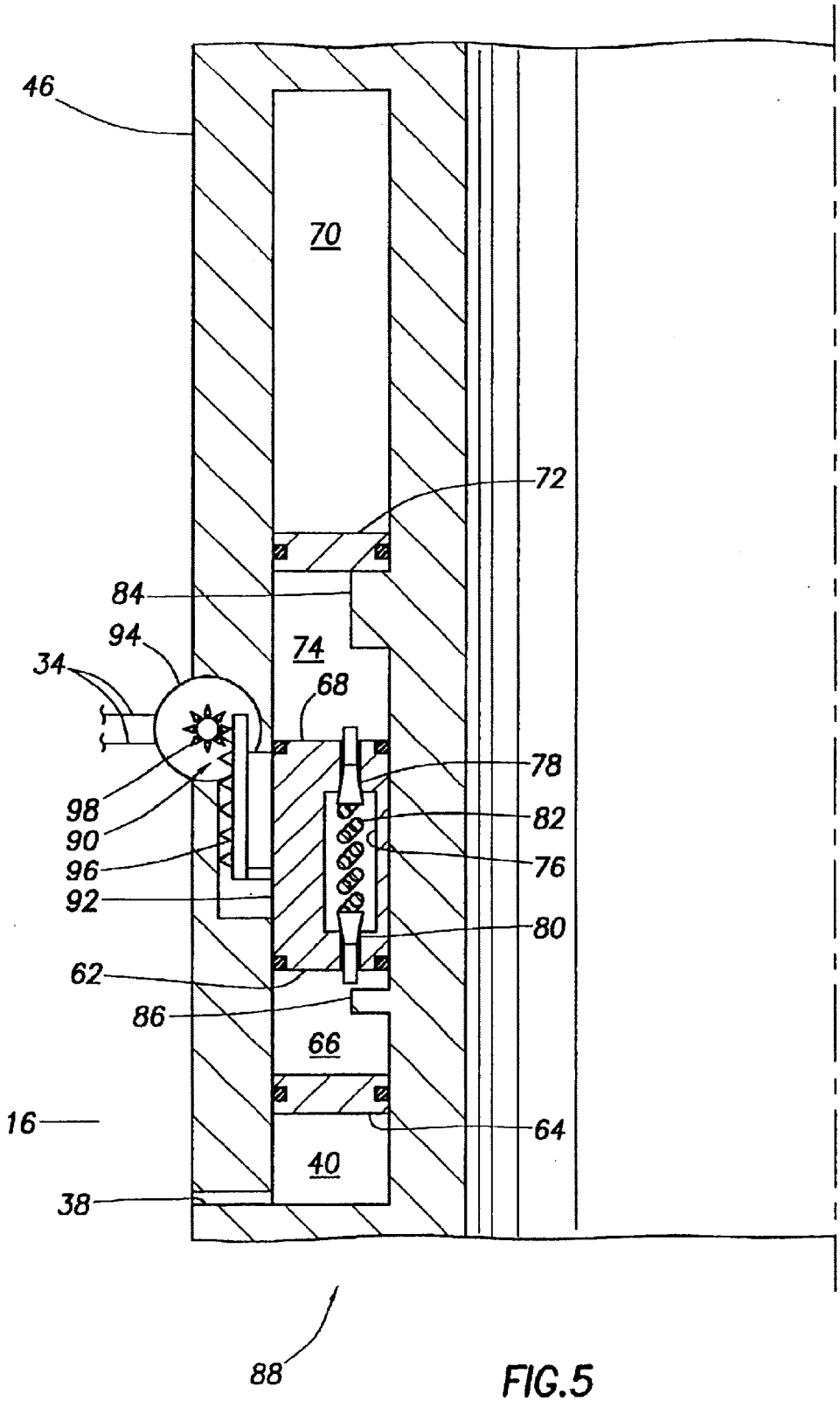
FIG. 5 is a quarter-sectional view of a second system for generating electric power downhole, the second system embodying principles of the invention.

Referring additionally now to FIG. 5, another generator assembly 88 embodying principles of the present invention is schematically and representatively illustrated. The generator assembly 88 is similar in many respects to the generator assembly 36 described above, and it may be used for the generator assembly 26 in the method 10. Of course, the generator assembly 88 may be used in other methods, without departing from the principles of the invention.

Elements of the generator assembly 88 which are the same as or very similar to corresponding elements of the generator assembly 36 are indicated in FIG. 5 using the same reference numbers. Note that the generator assembly 88 differs substantially from the generator assembly 36 in part in that it includes a mechanical linkage 90 between a piston 92 and a generator 94. Specifically, the mechanical linkage 90 is depicted as a rack and pinion, with the rack 96 attached to the piston 92 and the pinion 98 attached to the generator 94.

The piston 92 is made to reciprocate upwardly and downwardly in the generator assembly 88 in a similar manner as the piston 58 is made to reciprocate upwardly and downwardly in the generator assembly 36. That is, a pressure increase in the annulus 16 causes the piston 92 to displace upwardly, thereby charging the accumulator 70, and then the annulus pressure is decreased to displace the piston downwardly, thereby discharging the accumulator.

However, note that reciprocation of the piston 92 does not force a fluid to flow through a hydraulic circuit. Instead, reciprocation of the piston 92 displaces the rack 96 relative to the pinion 98, causing rotation of the pinion. This pinion rotation causes the generator 94 to generate electricity.

Note that the pinion 98 will rotate in opposite directions as the piston 92 alternately displaces upwardly and downwardly. If the generator 94 is a direct current generator, this reversing of rotation may also cause reversing of the polarity of the electricity generated by the generator. If the generator 94 produces alternating current, this reversing of rotation may not affect the output of the generator.

The depicted rack 96 and pinion 98 is merely representative of a wide variety of mechanical linkages which may be used between the piston 92 and the generator 94. For example, the mechanical linkage 92 may be a belt or chain drive, a ball screw, or any other type of linkage which transfers displacement of the piston 92 to drive the generator 94. The mechanical linkage 92 does not necessarily produce rotation at the generator 94 to drive the generator, since other types of displacement may be used to drive a generator.

Figure 6:
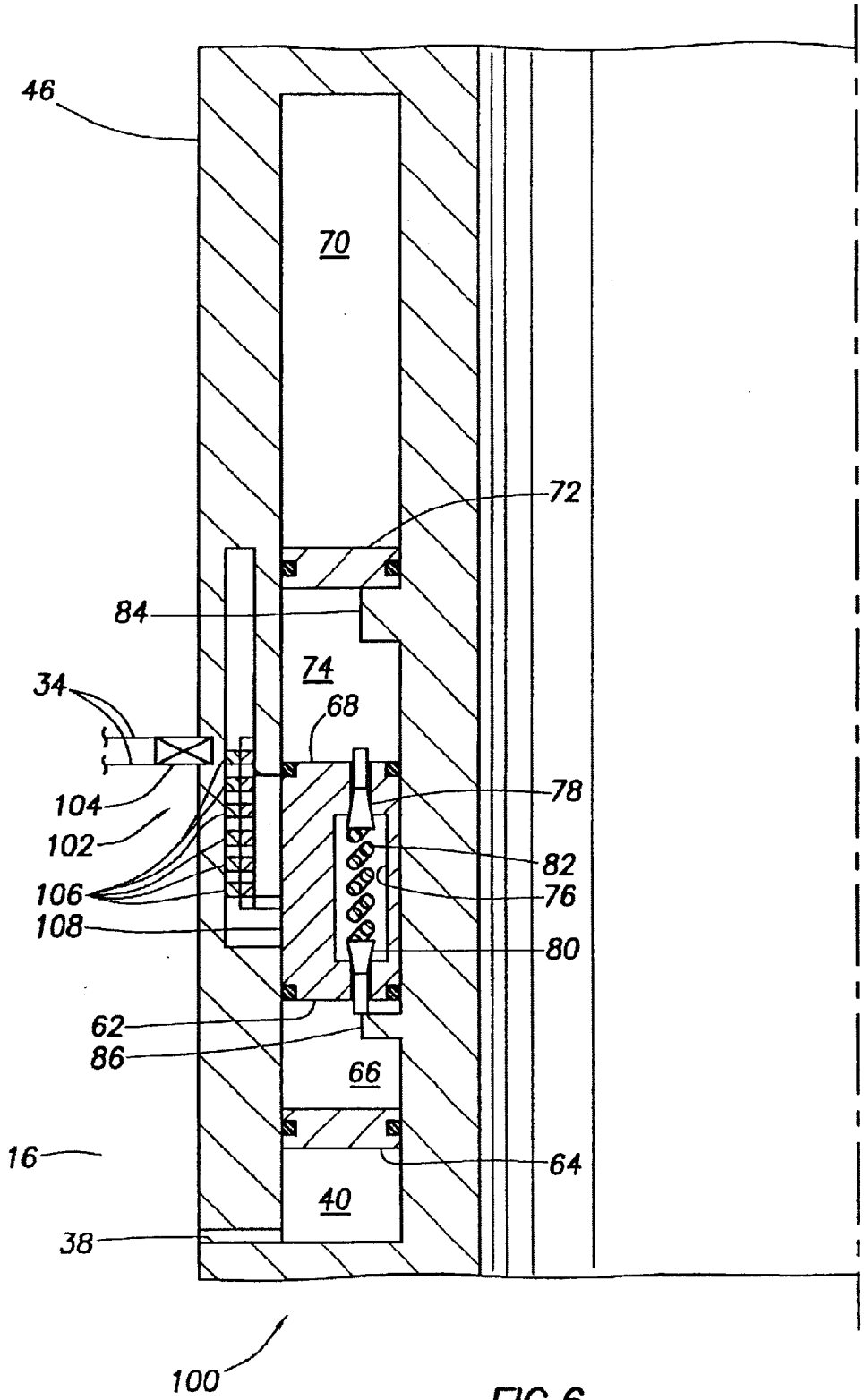
FIG. 6 is a quarter-sectional view of a third system for generating electric power downhole, the third system embodying principles of the invention.

Referring additionally now to FIG. 6, another generator assembly 100 embodying principles of the invention is representatively and schematically illustrated. The generator assembly 100 is similar in many respects to the generator assemblies 36, 88 described above, and it may be used for the generator assembly 26 in the method 10. Of course, the generator assembly 100 may be used in other methods, without departing from the principles of the invention.

Elements of the generator assembly 100 which are the same as or very similar to those described above are indicated in FIG. 6 using the same reference numbers. The generator assembly 100 differs substantially from the generator assemblies 36, 88 in part in that it does not include a generator which converts rotation into an electrical output. Instead, the generator assembly 100 includes a generator 102 which converts linear displacement into an electrical output.

Specifically, the generator 102 includes a coil 104 and a series of alternating polarity magnets 106. The magnets 106 are connected to a piston 108 which, similar to the pistons 58, 92 described above, reciprocates upwardly and downwardly in response to alternating pressure increases and decreases in the annulus 16. As each of the magnets 106 passes in close proximity to the coil 104, electric current is produced in the coil. Since successive ones of the magnets 106 alternate polarity, the current produced in the coil will also alternate direction and, therefore the generator 102 is an alternating current generator.

It will be readily appreciated that the magnets 106 can be displaced while the coil 104 remains stationary, the coil can be displaced while the magnets remain stationary, or both the coil and magnets could be displaced, as long as there is relative motion therebetween. For example, the coil 104 could be attached to the piston 108 for displacement therewith, while the magnets 106 could be attached to the housing 46.

It will also be recognized that many other variations of the generator 102 could be used. For example, the magnets 106 could pass through the coil 104 rather than external thereto, the magnets could be configured to produce direct current rather than alternating current in the coil, etc. The generator 102 is depicted as being merely representative of a wide variety of generators which may be used to produce electricity in response to displacement of the piston 108.

Figure 7:
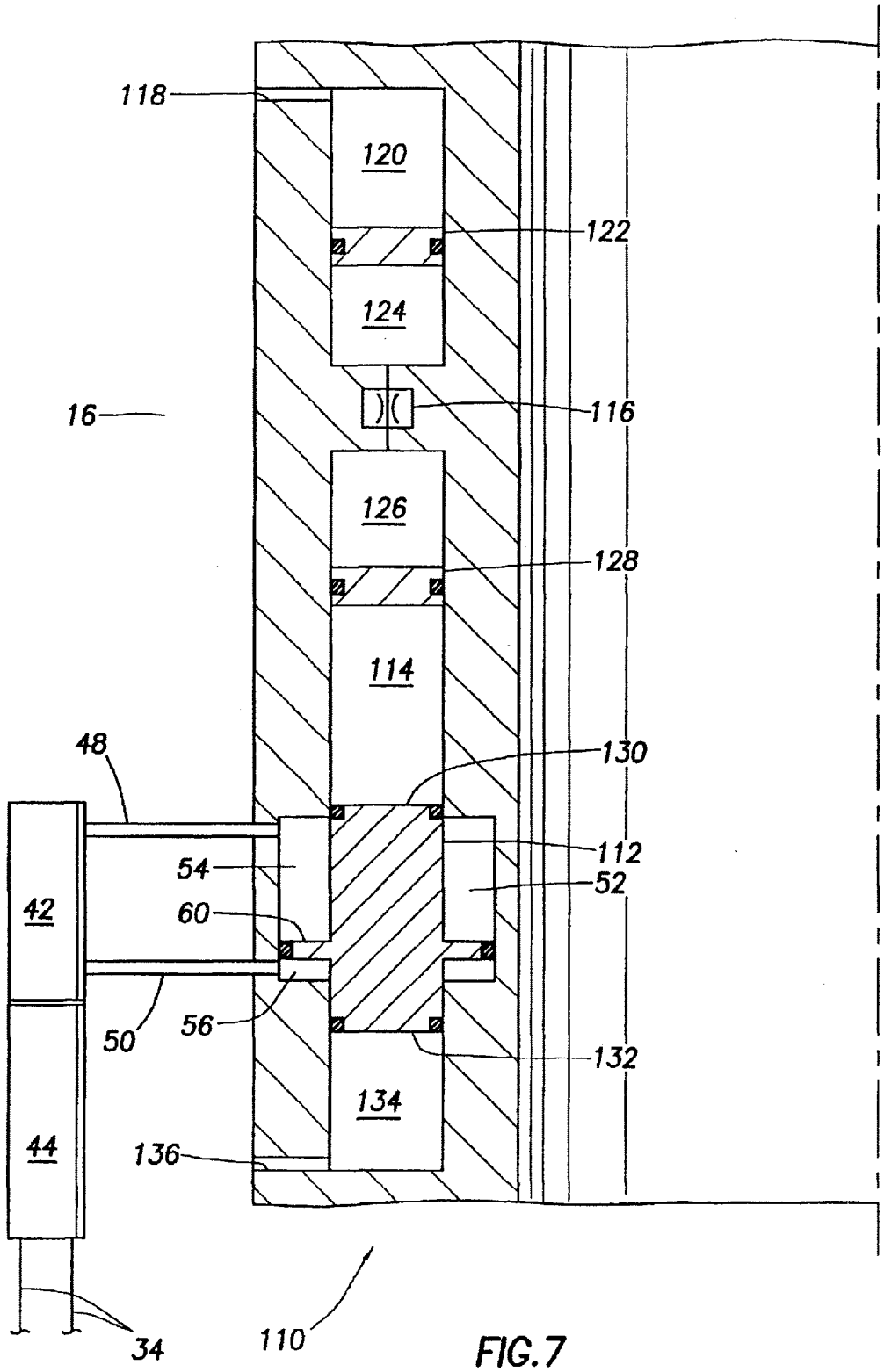
FIG. 7 is a quarter-sectional view of a fourth system for generating electric power downhole, the fourth system embodying principles of the invention.

Referring additionally now to FIG. 7, another generator assembly 110 embodying principles of the present invention is representatively and schematically illustrated. The generator assembly 110 may be used for the generator assembly 26 in the method 10. However, the generator assembly 110 may be used in other methods without departing from the principles of the invention.

In the generator assembly 110, a piston 112 is made to reciprocate upwardly and downwardly in response to pressure increases and decreases in the annulus 16, similar to the pistons 58, 92, 108 described above. Similar to the generator assembly 36, the piston 112 displacement forces hydraulic fluid through a hydraulic circuit which includes the hydraulic motor 42 and lines 48, 50 coupling the hydraulic motor to upper and lower chambers 54, 56 of the hydraulic reservoir 52. However, instead of charging the accumulator 70 when the annulus pressure is increased by flowing fluid through the passage 76 in the piston 58, the generator assembly 110 includes an accumulator 114 which is charged downhole by flowing fluid through a restrictor 116.

The accumulator 114 is initially charged prior to installation downhole. After installation, when the annulus pressure is increased, well fluid from the annulus 16 enters a port 118 and flows into a chamber 120. A floating piston 122 separates the chamber 120 from another chamber 124 containing a clean fluid, such as a hydraulic oil.

When the annulus pressure is greater than pressure in the accumulator 114, the fluid in the chamber 124 will flow through the restrictor 116 and into another chamber 126. The restrictor 116 is sized so that this flow is gradual, i.e., the fluid does not immediately flow between the chambers 124, 126. For example, the restrictor 116 may be sized so that a few minutes are required for the fluid to flow between the chambers 124, 126.

The chamber 126 is separated from pressurized gas in the accumulator 114 by another floating piston 128. It will be readily appreciated that, as the piston 128 displaces downwardly due to fluid gradually flowing from the chamber 124 to the chamber 126 through the restrictor 116, the pressure in the accumulator 114 gradually increases due to a reduced volume therein for the pressurized gas.

Since an upper surface area 130 of the piston 112 is exposed to the pressure in the accumulator 114, increased pressure will also be gradually applied to this upper surface area. In contrast, a lower surface area 132 of the piston 112 is exposed to the increased annulus pressure communicated to a chamber 134 via a port 136 to the annulus 16. Thus, the increased annulus pressure is applied substantially directly to the lower surface area 132 while increased pressure is applied gradually to the upper surface area 130 of the piston 112.

This results in a pressure differential across the piston 112 when the pressure in the annulus 16 is initially increased. The pressure differential causes the piston 112 to displace upwardly, forcing hydraulic fluid to flow from the upper chamber 54, through the hydraulic motor 42, and into the lower chamber 56. The hydraulic motor 42 drives the generator 44 in response to this fluid flow, resulting in production of electricity.

As stated above, pressure in the accumulator 114 does gradually increase as the annulus pressure increases. In the embodiment depicted in FIG. 7, the pressure in the accumulator 114 eventually increases so that it is equal to the increased annulus pressure. Thus, pressure across the piston 112 eventually equalizes.

Of course, a person skilled in the art will appreciate that the generator assembly 110 could be differently configured so that the pressure in the accumulator 114 does not necessarily increase to equal the increased annulus pressure. However, in the embodiment depicted in FIG. 7, the accumulator 114 is charged to the increased annulus pressure after the piston 112 has displaced upwardly.

When the annulus pressure is decreased, pressure on the lower surface area 132 of the piston 112 is substantially immediately decreased. Pressure in the accumulator 114 does not decrease immediately, however, since the restrictor 116 permits only gradual flow of fluid from the chamber 126 to the chamber 124. Thus, pressure on the upper surface area 130 will be greater than pressure on the lower surface area 132 when the annulus pressure is decreased, thereby causing the piston to displace downwardly.

This downward displacement of the piston 112 will force hydraulic fluid to flow from the lower chamber 56, through the hydraulic motor 42, and into the upper chamber 54. In response, the hydraulic motor 42 will drive the generator 44, resulting in generation of electric power.

Eventually, flow of fluid through the restrictor 116 will permit the piston 128 to displace upwardly to its initial position, increasing the gas volume in the accumulator 114 and thereby reducing its pressure. At that point, the generator assembly 110 is again ready for another annulus pressure increase to displace the piston 112 upwardly. Thus, the piston 112 may be made to reciprocate upwardly and downwardly in response to alternate pressure increases and decreases in the annulus 16. The generator 44 generates electricity in response to each change in annulus pressure.

Figure 8:
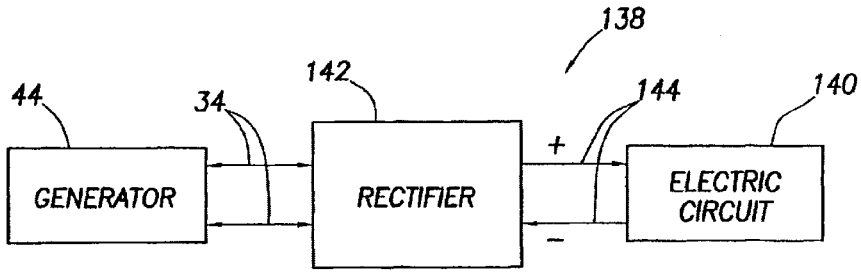
FIG. 8 is a schematic block diagram of an electric circuit usable in the method of FIG. 1.

Referring additionally now to FIG. 8, an electrical schematic 138 is illustrated which shows a representative method by which the electrical output of the generator 44 may be used to operate a power-consuming electric circuit 140. The electric circuit 140 may, for example, be a circuit in any of the devices 28, 30, 32 in the method 10, such as to provide power to a sensing circuit in the sensing device 32. Of course, the electrical output of the generator 44 may be used to operate other devices in other ways, without departing from the principles of the invention.

Where the generator 44 is a direct current generator, the polarity of the electricity output by the generator may reverse when annulus pressure alternates between increasing and decreasing. This is indicated in FIG. 8 by the lines 34 having opposing arrowheads. To convert this reversing polarity output of the generator 44 into a consistent polarity usable by the electric circuit 140, a full wave rectifier 142 is interconnected between the generator 44 and the electric circuit 140. The consistent polarity output of the rectifier 142 is indicated in FIG. 8 by lines 144 having only a single arrowhead each.

Figure 9:
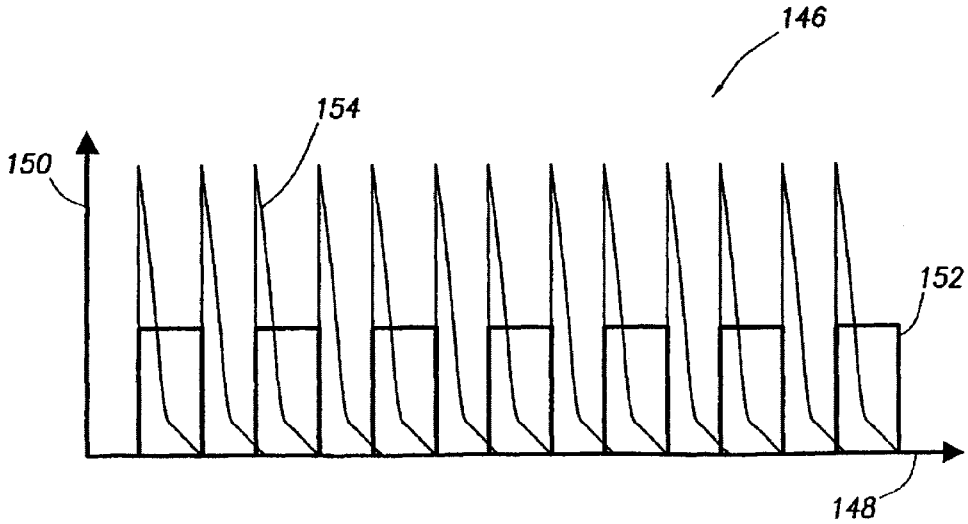
FIG. 9 is a graph showing a relationship between annulus pressure and generated electric power in the method of FIG. 1.

Referring additionally now to FIG. 9, an output of the rectifier 142 in relation to pressure increases and decreases in the annulus 16 is representatively illustrated in a graph 146. A horizontal axis 148 of the graph 146 indicates time, and a vertical axis 150 indicates electrical output and pressure.

A plot 152 of annulus pressure shows that annulus pressure is alternately increased and decreased, producing a square-wave plot shape. A plot of electrical output 154 shows that each time annulus pressure is either increased or decreased, an electrical output is produced.

Although the electrical output shown in FIG. 9 may be relatively short in duration for each annulus pressure increase and decrease, it will be readily appreciated that techniques well known to those skilled in the art may be utilized to extend the duration of each electrical output, or to increase the frequency of the annulus pressure increases and decreases, etc. Thus, the graph 146 is merely representative of how the principles of the invention may be used to generate electric power from changes in annulus pressure.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A system for generating electric power in a subterranean wellbore, the system comprising:

a piston which displaces in response to a change in pressure is an annulus formed between a tubular string and the wellbore, the change in annulus pressure causing the piston to displace both when the annulus pressure increases and when the annulus pressure decreases; and an electric generator which generates electricity in response to displacement of the piston, the piston being connected to the generator so that displacement of the piston causes the electricity to be generated both when the annulus pressure increases and when the annulus pressure decreases, whereby electricity is generated in response to the change in annulus pressure.

2. The system according to claim 1, wherein the change in annulus pressure is an increase in annulus pressure, electricity being generated in response to the increase in annulus pressure.

3. The system according to claim 1, wherein displacement of the piston displaces a fluid, the generator generating electricity in response to displacement of the fluid.

4. The system according to claim 3, wherein displacement of the piston displaces the fluid through a hydraulic motor connected to the generator.

5. The system according to claim 4, wherein the hydraulic motor is a turbine.

6. The system according to claim 1, further comprising a mechanical linkage interconnected between the piston and the generator.

7. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, and wherein the change in annulus pressure is a decrease in annulus pressure, electricity being generated in response to the decrease in annulus pressure.

8. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, and wherein the change in annulus pressure includes both an increase and a decrease in annulus pressure, electricity being generated in response to both the increase and decrease in annulus pressure.

9. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, wherein displacement of the piston displaces a fluid, the generator generating electricity in response to displacement of the fluid, wherein displacement of the piston displaces the fluid through a hydraulic motor connected to the generator, and wherein the piston displaces the fluid through a hydraulic circuit in a first direction when the change in annulus pressure is an increase in annulus pressure, and wherein the piston displaces the fluid through the hydraulic circuit in a second direction opposite to the first direction when the change in annulus pressure is a decrease in annulus pressure.

10. The system according to claim 9, wherein the hydraulic motor drives the generator in a third direction when the fluid displaces in the first direction through the hydraulic circuit, and wherein the hydraulic motor drives the generator in a fourth direction opposite to the third direction when the fluid displaces in the second direction through the hydraulic circuit.

11. The system according to claim 10, wherein the generator generates direct current electricity having a first polarity when the hydraulic motor drives the generator in the third direction, and wherein the generator generates direct current electricity having a second polarity opposite to the first polarity when the hydraulic motor drives the generator in the fourth direction.

12. The system according to claim 10, wherein the generator generates alternating current electricity when the hydraulic motor drives the generator in the third direction and when the hydraulic motor drives the generator in the fourth direction.

13. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, wherein a mechanical linkage is interconnected between the piston and the generator, and wherein the mechanical linkage is a rack and pinion.

14. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, wherein a mechanical linkage is interconnected between the piston and the generator, and wherein the mechanical linkage drives the generator in a first direction when the change in annulus pressure is an increase in annulus pressure, and wherein the mechanical linkage drives the generator in a second direction opposite to the first direction when the change in annulus pressure is a decrease in annulus pressure.

15. The system according to claim 14, wherein the generator generates direct current electricity having a first polarity when the mechanical linkage drives the generator in the first direction, and wherein the generator generates direct current electricity having a second polarity opposite to the first polarity when the mechanical linkage drives the generator in the second direction.

16. The system according to claim 14, wherein the generator generates alternating current electricity when the hydraulic motor drives the generator in the first direction and when the hydraulic motor drives the generator in the second direction.

17. A system for generating electric power in a subterranean wellbore, the system comprising:

a structure which displaces in response to a change in well pressure; and an electric generator which generates electricity in response to displacement of the structure, whereby electricity is generalized in response to the change in well pressure, wherein the structure is a piston which displaces in response to the change in well pressure in an annulus formed between a tubular string and the wellbore, and wherein a first portion of the generator is connected to the piston for displacement therewith relative to a second portion of the generator.

18. The system according to claim 17, wherein the first generator portion is a selected one of a coil and one or more magnets, and wherein the second generator portion is the other of the coil and the magnets.

19. A system for generating electric power in a subterranean wellbore, the system comprising:

a structure which displaces in response to a change in well pressure; and an electric generator which generates electricity in response to displacement of the structure, whereby electricity is generated in response to the change in well pressure, wherein the structure is a piston which displaces in response to the change in well pressure in an annulus formed between a tubular string and the wellbore, and further comprising a rectifier interconnected between the generator and a power consuming electrical circuit.

20. A system for generating electric power in a subterranean wellbore, the system comprising:

a structure operative to displace in response to a change in well pressure, the change in well pressure causing the structure to displace both when the well pressure increases and when the well pressure decreases;

a reservoir having hydraulic fluid therein, the hydraulic fluid displacing in response to displacement of the structure;

a hydraulic motor which rotates in response to displacement of the hydraulic fluid; and a generator which generates electricity in response to rotation of the hydraulic motor both when the well pressure increases and when the well pressure decreases.

21. The system according to claim 20, wherein the structure is a piston which is operative to displace in response to the change in well pressure in an annulus formed between a tubular string and the wellbore.

22. The system according to claim 21, wherein the hydraulic fluid displaces from the reservoir, through the hydraulic motor, and returns to the reservoir in response to displacement of the piston.

23. The system according to claim 21, wherein the piston has opposite first and second sides, the first side being exposed to a first chamber in fluid communication with the annulus, and the second side being exposed to a second chamber in fluid communication with an accumulator.

24. A system for generating electric power in a subterranean wellbore, the system comprising:

a structure operative to displace in response to a change in well pressure;

a reservoir having hydraulic fluid therein, the hydraulic fluid displacing in response to displacement of the structure;

a hydraulic motor which rotates in response to displacement of the hydraulic fluid; and a generator which generates electricity in response to rotation of the hydraulic motor, wherein the structure is a piston which is operative to displace in response to the change in well pressure in an annulus formed between a tubular string and the wellbore, wherein the hydraulic fluid displaces through a hydraulic circuit including the hydraulic motor, the fluid displacing through the hydraulic circuit in a first direction in response to displacement of the piston in a second direction, and the fluid displacing through the hydraulic circuit in a third flowing direction opposite to the first direction in response to displacement of the piston in a fourth direction opposite to the second direction.

25. A system for generating electric power in a subterranean wellbore, the system comprising:

a structure operative to displace in response to a change in well pressure;

a reservoir having hydraulic fluid therein, the hydraulic fluid displacing in response to displacement of the structure;

a hydraulic motor which rotates in response to displacement of the hydraulic fluid; and a generator which generates electricity in response to rotation of the hydraulic motor;

wherein the structure is a piston which is operative to displace in response to the change in well pressure in an annulus formed between a tubular string and the wellbore, and wherein the hydraulic fluid displaces through the hydraulic motor in a first flowing direction, thereby rotating the hydraulic motor in a first rotating direction, when the change in annulus pressure is an increase in annulus pressure, and wherein the hydraulic fluid displaces through the hydraulic motor in a second flowing direction opposite to the first flowing direction, thereby rotating the hydraulic motor in a second rotating direction opposite to the first rotating direction, when the change in annulus pressure is an increase in annulus pressure.

26. A system for generating electric power in a subterranean wellbore, the system comprising:

a structure operative to distance in response to a change in well pressure;

a reservoir having hydraulic fluid therein, the hydraulic fluid displacing in response to displacement of the structure;

a hydraulic motor which rotates in response to displacement of the hydraulic fluid;

a generator which generates electricity in response to rotation of the hydraulic motor, wherein the structure is a piston which is operative to displace in response to the change in well pressure in an annulus formed between a tubular string and the wellbore, the piston having opposite first and second sides, the first side being exposed to a first chamber in fluid communication with the annulus, and the second side being exposed to a second chamber in fluid communication with an accumulator, and further comprising first and second check valves and a passage providing fluid communication between the first and second chambers, wherein the first check valve permits flow through the passage and the second check valve prevents flow through the passage until the piston has displaced a predetermined distance in a first direction when the change in annulus pressure is an increase in annulus pressure, and wherein the second check valve permits flow through the passage and the first check valve prevents flow through the passage until the piston has displaced the predetermined distance in a second direction when the change in annulus pressure is an decrease in annulus pressure.

27. A system for generating electric power in a subterranean wellbore, the system comprising:

a structure operative to displace in response to a change in well pressure;

a reservoir having hydraulic fluid therein, the hydraulic fluid displacing in response to displacement of the structure;

a hydraulic motor which rotates in response to displacement of the hydraulic fluid;

a generator which generates electricity in response to rotation of the hydraulic motor, wherein the structure is a piston which is operative to displace in response to the change in well pressure in an annulus formed between a tubular string and the wellbore, the piston having opposite first and second sides, the first side being exposed to a first chamber in fluid communication with the annulus, and the second side being exposed to a second chamber in fluid communication with an accumulator, and wherein the accumulator is in fluid communication with the annulus via a flow restrictor, whereby the change in annulus pressure is directly communicated to the first side of the piston, but the restrictor delays the communication of the change in annulus pressure to the second side of the piston.

28. A system for generating electric power in a subterranean wellbore, the system comprising:

a structure operative to displace in response to a change in well pressure;

a reservoir having hydraulic fluid therein, the hydraulic fluid displacing in response to displacement of the structure;

a hydraulic motor which rotates in response to displacement of the hydraulic fluid; and a generator which generates electricity in response to rotation of the hydraulic motor, wherein the structure is a piston which is operative to displace in response to the change in well pressure in an annulus formed between a tubular string and the wellbore, and wherein the generator generates direct current electricity having a first polarity when the change in annulus pressure is an increase in annulus pressure, and wherein the generator generates direct current electricity having a second polarity opposite to the first polarity when the change in annulus pressure is a decrease in annulus pressure.

29. A system for generating electric power in a subterranean wellbore, the system comprising:

a structure operative to displace in response to a change in well pressure;

a reservoir having hydraulic fluid therein, the hydraulic fluid displacing in response to displacement of the structure;

a hydraulic motor which rotates in response to displacement of the hydraulic fluid, and a generator which generates electricity in response to rotation of the hydraulic motor, wherein the structure is a piston which is operative to displace in response to the change in well pressure in an annulus formed between a tubular string and the wellbore, and wherein the generator generates alternating current electricity when the change in annulus pressure is an increase in annulus pressure and when the change in annulus pressure is a decrease in annulus pressure.

30. A method of generating electric power in a subterranean wellbore of a well, the method comprising the steps of:

positioning an accumulator in the wellbore;

changing pressure in the well proximate the accumulator;

flowing well fluid through an opening of the accumulator in response to the pressure changing step; and generating electricity in response to the well fluid flowing through the opening.

31. The method according to claim 30, wherein the positioning step further comprises interconnecting the accumulator in a tubular string, and forming an annulus between the tubular string and the wellbore, and wherein the pressure changing step further comprises changing pressure in the annulus proximate the accumulator.

32. A method according to claim 31, wherein the electricity generating step is performed in response to well fluid flowing through the opening in a first direction, and wherein the electricity generating step is performed in response to well fluid flowing through the opening in a second direction opposite to the first direction.

33. The method according to claim 31, wherein well fluid flows into the accumulator through the opening when annulus pressure is increased in the pressure changing step, and wherein well fluid flows out of the accumulator through the opening when annulus pressure is decreased in the pressure changing step.

34. The method according to claim 31, further comprising the step of displacing a piston in response to the pressure changing step, and wherein the electricity generating step is performed further in response to the piston displacing step.

35. The method according to claim 34, wherein the piston displacing step further comprises causing relative displacement between a coil and one or more magnets of a generator, and wherein the electricity generating step further comprises generating electricity as a result of the relative displacement between the coil and magnets.

36. The method according to claim 34, wherein the piston displacing step further comprises displacing a hydraulic fluid with the piston, and wherein the electricity generating step further comprises generating electricity as a result of the displacement of the hydraulic fluid.

37. The method according to claim 36, wherein the hydraulic fluid displacing step further comprises displacing the hydraulic fluid through a hydraulic motor.

38. The method according to claim 37, wherein the hydraulic fluid displacing step further comprises driving an electric generator with the hydraulic motor.

39. The method according to claim 31, further comprising the step of rectifying the electricity generated in the generating electricity step.

40. A method of generating electric power in a subterranean wellbore of a well, the method comprising the step of:

positioning an accumulator in the wellbore, including interconnecting the accumulator in a tubular string, and forming an annulus between the tubular string and the wellbore;

changing pressure in the well proximate the accumulator, including changing pressure in the annulus proximate the accumulator;

flowing well fluid through an opening of the accumulator in response to the pressure changing step;

displacing a piston in response to the pressure changing step, including displacing a hydraulic fluid with the piston, the hydraulic fluid displacing through a hydraulic motor, thereby driving an electric generator with the hydraulic motor; and generating electricity in response to the well fluid flowing through the opening, and further in response to the piston displacing step, and as a result of the displacement of the hydraulic fluid, wherein the electric generator driving step further comprises driving the generator in a first direction when annulus pressure is increased in the pressure changing step, and wherein the electric generator driving step further comprises driving the generator in a second direction opposite to the first direction when annulus pressure is decreased in the pressure changing step.

41. A method of generating electric power in a subterranean wellbore of a well, the method comprising the steps of:

positioning an accumulator in the wellbore, including interconnecting the accumulator in a tubular string, and forming an annulus between the tubular string and the wellbore;

changing pressure in the well proximate the accumulator, including changing pressure in the annulus proximate the accumulator;

displacing a piston in response to the pressure changing step;

flowing well fluid through an opening of the accumulator in response to the pressure changing step; and generating electricity in response to the well fluid flowing through the opening, and further in response to the piston displacing step, and wherein the piston displacing step further comprises operating a mechanical linkage interconnected between the piston and a generator.

42. A method of generating electric power in a subterranean wellbore of a well, the method comprising the steps of:

positioning an accumulator in the wellbore, including interconnecting the accumulator in a tubular string, and forming an annulus between the tubular string and the wellbore;

changing pressure in the well proximate the accumulator, including changing flowing well fluid through an opening of the accumulator in response to the pressure changing step;

generating electricity in response to the well fluid flowing through the opening; and rectifying the electricity generated in the generating electricity step, and wherein the rectifying step is performed by interconnecting a full wave rectifier between a generator and a power consuming electrical circuit.

43. A method of generating electric power in a subterranean wellbore, the method comprising the steps of:

positioning a tubular string in the wellbore, thereby forming an annulus between the tubular string and the wellbore;

changing pressure in the annulus, including both increasing and decreasing pressure in the annulus, and thereby causing a piston to displace both when the annulus pressure increases and decreases; and generating electric power in response to the pressure changing step, the electric power being generated in response to the piston displacement both when the annulus pressure increases and when the annulus pressure decreases.

44. The method according to claim 43, further comprising the step of isolating the annulus from an interior of the tubular string, and wherein the pressure changing step further comprises changing pressure in the annulus while the annulus is isolated from the tubular string interior.

45. The method according to claim 44, further comprising the step of altering pressure in an accumulator interconnected in the tubular string in response to the pressure changing step.

46. The method according to claim 45, wherein the accumulator pressure altering step further comprises displacing the piston.

47. The method according to claim 46, wherein the piston displacing step causes displacement of at least a portion of a generator in the electric power generating step.

48. The method according to claim 44, wherein the pressure changing step further comprises forcing a fluid through a hydraulic circuit, thereby operating a hydraulic motor.

49. A method of generating electric power in a subterranean wellbore, the method comprising the steps of:

positioning a tubular string in the wellbore, thereby forming an annulus between the tubular string and the wellbore;

isolating the annulus from an interior of the tubular string;

changing pressure in the annulus while the annulus is isolated from the tubular string interior; and generating electric power in response to the pressure changing step, and wherein the piston displacing step further comprises driving a generator via a mechanical linkage interconnected between the piston and the generator.

50. A method of generating electric power in a subterranean wellbore, the method comprising the steps of:

positioning a tubular string in the wellbore, thereby forming an annulus between the tubular string and the wellbore;

isolating the annulus from an interior of the tubular string;

changing pressure in the annulus while the annulus is isolated from the tubular string interior; and generating electric power in response to the pressure changing step, and wherein the piston displacing step further comprises displacing a first portion of a generator with the piston relative to a second portion of the generator.

* * * * *